US005492105A

United States Patent [19]

Nakajima et al.

[11] Patent Number: 5,492,105

[45] Date of Patent: Feb. 20, 1996

[54] IGNITION SYSTEM FOR INTERNAL COMBUSTION ENGINE

[75] Inventors: Keiichi Nakajima; Tadashi Fujita, both of Yokkaichi, Japan

[73] Assignee: Sumitomo Wiring Systems, Ltd., Yokkaichi, Japan

[21] Appl. No.: 299,426

[22] Filed: Sep. 1, 1994

[30] Foreign Application Priority Data

Nov. 11, 1993 [JP] Japan ..... 5-060776 U

[51] Int. Cl.[6] ..... F02P 11/00

[52] U.S. Cl. ..... 123/635; 123/169 PA; 439/125

[58] Field of Search ..... 123/635, 169 PA, 123/169 PH, 634, 633; 336/107; 439/125, 126, 127, 128, 843, 844, 841, 845, 846

[56] References Cited

U.S. PATENT DOCUMENTS

| | | | |
|---|---|---|---|
| 4,706,639 | 11/1987 | Boyer et al. | 123/647 |
| 4,715,337 | 12/1987 | Bohl et al. | 123/169 PA |
| 5,170,767 | 12/1992 | Wada et al. | 123/633 |
| 5,261,381 | 11/1993 | Sugiura et al. | 123/630 |
| 5,333,592 | 8/1994 | Benedikt et al. | 123/634 |
| 5,340,323 | 8/1994 | Imanishi et al. | 439/125 |
| 5,357,233 | 10/1994 | Wada | 336/107 |
| 5,406,242 | 4/1995 | Klocinski et al. | 336/107 |
| 5,411,006 | 5/1995 | Noble et al. | 123/634 |
| 5,419,300 | 5/1995 | Maruyama et al. | 123/634 |

FOREIGN PATENT DOCUMENTS

| | | | |
|---|---|---|---|
| 0443594 | 8/1991 | European Pat. Off. | 123/635 |
| 0470938 | 2/1992 | European Pat. Off. | 123/635 |
| 0508374 | 10/1992 | European Pat. Off. | 123/635 |
| 4370370 | 12/1992 | Japan | 439/125 |
| 5-21175 | 3/1993 | Japan | 439/125 |
| 5-52175 | 3/1993 | Japan | 123/635 |
| 5-30467 | 4/1993 | Japan | 439/125 |
| 8604480 | 8/1986 | WIPO | 123/635 |
| 9309345 | 5/1993 | WIPO | 123/635 |

OTHER PUBLICATIONS

European Search Report of Jul. 7, 1995.
Patents Abstracts of Japan, vol. 017, No. 465 (M-1468), Aug. 25, 1993.
English language Abstract of JP-5-52175.
English language Abstract of JP-4-370370.
Partial English language description of JP-5-21175.
Partial English language description of JP-5-30467.

*Primary Examiner*—Raymond A. Nelli
*Attorney, Agent, or Firm*—Sandler, Greenblum, & Bernstein

[57] ABSTRACT

An ignition system for an internal combustion engine, comprising: a tubular insulating member which has a through-hole;

a tubular terminal which is mounted in an upper portion of the through-hole; an ignition coil which has a first terminal;

the first terminal being fitted into an upper portion of the terminal so as to be electrically connected to the terminal; a coiled spring which is attached to a lower portion of the terminal and is loosely fitted into a lower portion of the through-hole; a spark plug which has a second terminal fitted into the through-hole from a lower portion of the insulating member; the second terminal being brought into contact with the coiled spring so as to be electrically connected to the coiled spring; and a buckling preventive portion for reducing an inside diameter of the through-hole, which is provided at a portion of the through-hole between the lower portion of the terminal and an upper portion of the second terminal so as to prevent buckling of an intermediate portion of the coiled spring.

1 Claim, 4 Drawing Sheets

IGNITION SYSTEM FOR INTERNAL COMBUSTION ENGINE

BACKGROUND OF THE INVENTION

The present invention generally relates to an ignition system for an internal combustion engine and more particularly, to an improved construction for connecting an ignition coil and a spark plug in the ignition system.

In a known ignition system for an internal combustion engine, a tubular terminal 2A or 2B is mounted in an upper portion of a through-hole 1*a* of a tubular insulating member 1 and an electrode 4 of an ignition coil 3 is fitted into an upper portion of the terminal 2A or 2B so as to be electrically connected to the terminal 2A or 2B as shown in FIG. 1 or FIG. 2. Meanwhile, a coiled spring 5 attached to a lower portion of the terminal 2A and 2B is loosely fitted into a lower portion of the through-hole 1*a* of the insulating member 1. Furthermore, an electrode 7 of a spark plug 6 is fitted into the through-hole 1*a* from a lower end of the insulating member 1 and is brought into contact with the coiled spring 5 so as to be electrically connected to the terminal 2A or 2B. Meanwhile, in FIGS. 1 and 2, reference numeral 8 denotes a mounting hole formed in a cylinder head of the engine. In the known ignition system, a distance L1 or L2 (L1<L2) between the electrode 4 of the ignition coil 3 and the electrode 7 of the spark plug 6 varies according to types of the internal combustion engine. In case the distances L1 and L2 are different from each other as described above, lengths H1 and H2 (H1<H2) of the insulating member 1 are also different from each other and a length H3 of the terminal 2A is also different from a length H4 (H3<H4) of the terminal 2B. Therefore, in accordance with variations of the distance L1 or L2 between the electrode 4 of the ignition coil 3 and the electrode 7 of the spark plug 6, different molding dies for producing the insulating member 1 and the terminal 2A or 2B having different lengths should be prepared, thereby resulting in increased production cost of the ignition system. Meanwhile, since kinds of the components of the ignition system increases, control of the components becomes complicated, so that such a possibility exists that wrong components are used for the ignition system, thereby resulting in deterioration of reliability of the ignition system.

In order to obviate this problem, it may be considered that the terminal 2A having the length H3 shorter than the length H4 of the terminal 2B is used in common for the lengths L1 and L2 between the electrode 4 of the ignition coil 3 and the electrode 7 of the spark plug 6 and difference between the lengths L1 and L2 is eliminated by changing compression amount of the coiled spring 5 such that drop of production cost of the components and facilitation of control of the components are pursued. However, if the amount of compression of the coiled spring 5 changes, force at which the coiled spring 5 is brought into contact with the electrode 7 of the spark plug 6, namely, reaction force of the coiled spring 5 changes and thus, it is preferable that spring constant of the coiled spring 5 is as small as possible. In order to make the spring constant of the coiled spring 5 small, wire diameter of the coiled spring 5 may be reduced or coil diameter of the coiled spring 5 may be increased. However, in case the wire diameter of the coiled spring 5 is reduced, efficiency for mounting the coiled spring 5 deteriorates. On the other hand, if the coil diameter of the coiled spring 5 is increased, it may be impossible to fit the coiled spring 5 into the terminal 2A.

As a result, the coiled spring 5 should have small spring constant and small coil diameter. In this case, ratio of longitudinal length to lateral length of the coiled spring 5, i.e., ratio of free height to mean coil diameter of the coiled spring 5 increases. This ratio preferably ranges from 0.8 to 4 generally. If the ratio exceeds this range, such a problem arises that when the spark plug 6 has been fitted into the through-hole 1*a* of the insulating member 1, buckling of the coiled spring 5 is likely to take place as shown by the two-dot chain lines in FIG. 3.

SUMMARY OF THE INVENTION

Accordingly, an essential object of the present invention is to provide, with a view to eliminating the above mentioned drawbacks of prior art ignition systems, an ignition system for an internal combustion engine, in which even if distance between an electrode of an ignition coil and an electrode of a spark plug changes, one terminal can be used in common.

In order to accomplish this object of the present invention, an ignition system for an internal combustion engine, according to the present invention comprises: a tubular insulating member which has a through-hole; a tubular terminal which is mounted in an upper portion of the through-hole of the insulating member; an ignition coil which has a first terminal; the first terminal being fitted into an upper portion of the terminal so as to be electrically connected to the terminal; a coiled spring which is attached to a lower portion of the terminal and is loosely fitted into a lower portion of the through-hole of the insulating member; a spark plug which has a second terminal fitted into the through-hole from a lower portion of the insulating member; the second terminal being brought into contact with the coiled spring so as to be electrically connected to the coiled spring; and a buckling preventive portion for reducing an inside diameter of the through-hole of the insulating member, which is provided at a portion of the through-hole between the lower portion of the terminal and an upper portion of the second terminal so as to prevent buckling of an intermediate portion of the coiled spring.

In accordance with the present invention, since the buckling preventive portion for reducing the inside diameter of the through-hole of the insulating member is provided at the portion of the through-hole between the lower portion of the terminal fitted in the upper portion of the through-hole and the upper portion of the second terminal of the spark plug fitted into the through-hole from the lower portion of the insulating member so as to restrain the intermediate portion of the coiled spring, buckling of the coiled spring is prevented. Even if distance between the first terminal of the ignition coil and the second terminal of the spark plug changes, this change of the distance can be absorbed as compression amount of the coiled spring, so that only one kind of the tubular terminal can be used in common.

BRIEF DESCRIPTION OF THE DRAWINGS

This object and features of the present invention will become apparent from the following description taken in conjunction with the preferred embodiment thereof with reference to the accompanying drawings, in which.

Before the description of the present invention proceeds, it is to be noted that like parts are designated by like reference numerals throughout the accompanying drawings.

DETAILED DESCRIPTION OF THE INVENTION

Figure 4:
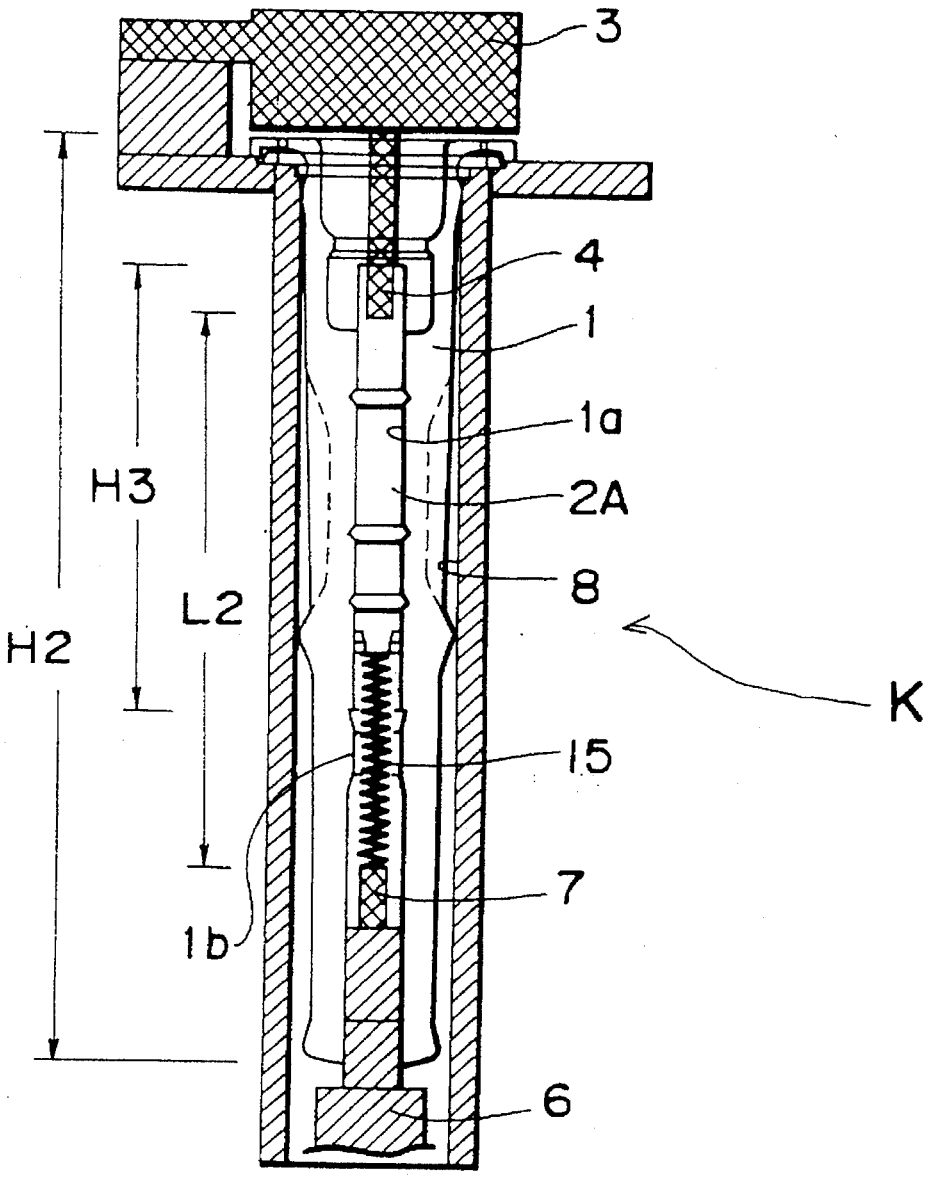
FIG. 4 is a sectional view of an ignition system according to the present invention.
Figure 5:
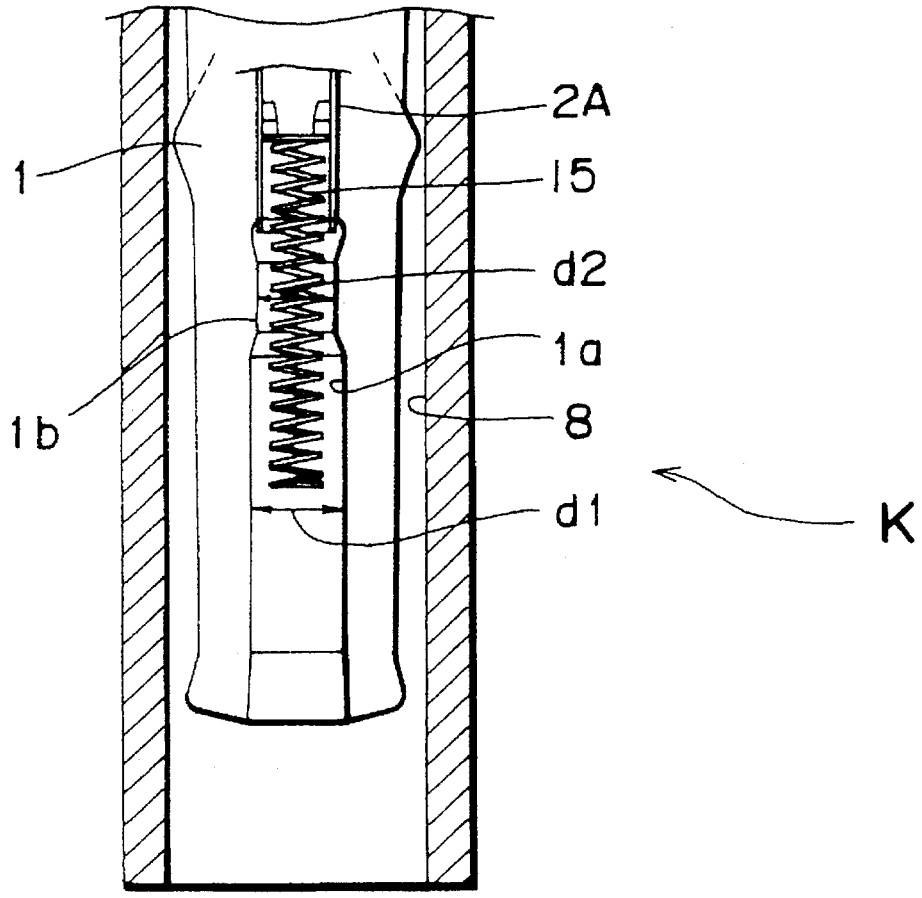
FIG. 5 is an enlarged fragmentary sectional view of the ignition system of FIG. 4.

Referring now to the drawings, there is shown in FIGS. 4 and 5, an ignition system K for an internal combustion engine, according to one embodiment of the present invention. The ignition system K is of a type in which a distance L2 between an electrode 4 of an ignition coil 3 and an electrode 7 of a spark plug 6 is long. In the ignition system K, a length H2 of a tubular insulating member 1 is increased accordingly but a length H3 of a tubular terminal 2A mounted in an upper portion of a through-hole 1*a* of the insulating member 1 is set to be short.

The insulating member 1 is fitted into a mounting hole 8 formed in a cylinder head of the engine. Meanwhile, the electrode 4 of the ignition coil 3 is fitted into an upper portion of the terminal 2A mounted in the through-hole 1*a* of the insulating member 1 so as to be electrically connected to the terminal 2A. On the other hand, an upper portion of a coiled spring 15 is attached to a lower portion of the terminal 2A, while an intermediate portion and a lower portion of the coiled spring 15 are loosely fitted into a lower portion of the through-hole 1*a* of the insulating member 1.

The electrode 7 of the spark plug 6 is fitted into a lower portion of the through-hole 1*a* of the insulating member 1. The coiled spring 15 is brought into contact with an upper portion of the electrode 7 and is compressed between the electrode 7 and the terminal 2A so as to be electrically connected to the coiled spring 15. Thus, the electrode 4 of the ignition coil 3 and the electrode 7 of the spark plug 6 are electrically connected to each other through the terminal 2A and the coiled spring 15.

Figure 2:
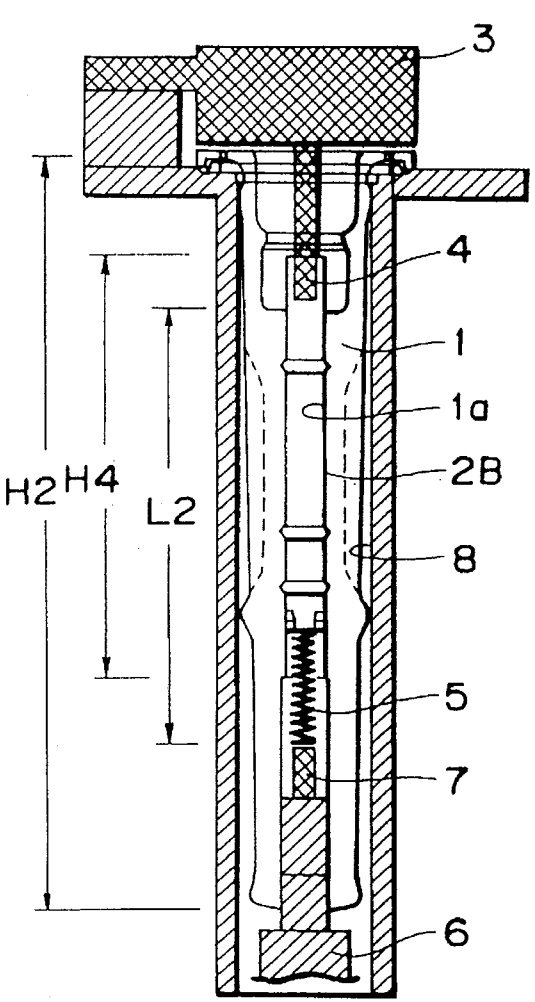
Fig.2 PRIOR ART
FIGS. 1 and 2 are sectional views of prior art ignition systems in which distance between an electrode of an ignition coil and an electrode of a spark plug is short and long, respectively (already referred to)
Figure 1:
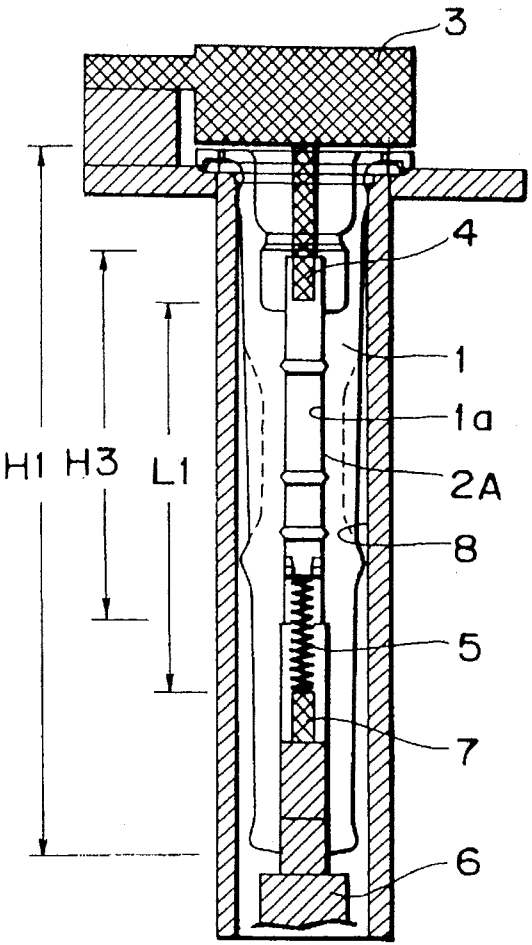
Fig.1 PRIOR ART

In the same manner as a known coiled spring 5 shown in FIGS. 1 and 2, the coiled spring 15 has small spring constant and small coil diameter. However, in contrast with the known coiled spring 5 of FIGS. 1 and 2, free height of the coiled spring 15 is set to be large. Namely, in this embodiment, the distance L2 between the electrode 4 of the ignition coil 3 and the electrode 7 of the spark plug 6 is the same as that of the known ignition system of FIG. 2. However, since the length H3 of the terminal 2A of the ignition system K is shorter than a length H4 of a terminal 2B of a known ignition system of FIG. 2, free height of the coiled spring 15 is set to be larger than that of the coiled spring 5 of the known ignition system of FIG. 2 by a difference of (H4-H3).

Meanwhile, in this embodiment, a buckling preventive portion 1*b* which is constituted by an annular projection for reducing an inside diameter d1 of the through-hole 1*a* of the insulating member 1 to an inside diameter d2 (d1>d2) is integrally formed at a portion of a peripheral surface of the through-hole la between the lower portion of the terminal 2A and the upper portion of the electrode 7 of the spark plug 6 as shown in FIG. 5.

Figure 3:
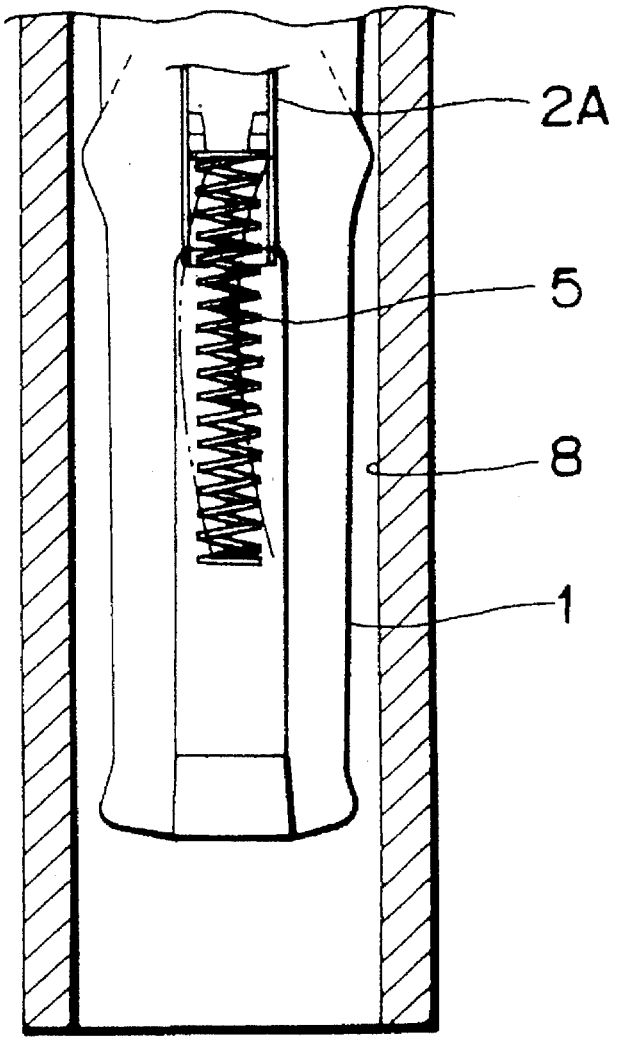
Fig. 3 PRIOR ART
FIG. 3 is a sectional view showing buckling of a coiled spring in a known ignition system (already referred to)

If the length of the coiled spring 15 is set to be large as described above, the ratio of longitudinal length to lateral length of the coiled spring 15, i.e., ratio of free height to mean coil diameter of the coiled spring 15 exceeds a desirable range of 0.8 to 4, so that an intermediate portion of the coiled spring 15 is likely to be buckled as shown by the two-dot chain lines in FIG. 3. However, since the intermediate portion of the coiled spring 15 is restrained by the buckling preventive portion 1*b* so as not to be displaced radially, buckling of the coiled spring 15 does not occur.

In the ignition system K of the above described arrangement, even if the distance between the electrode 4 of the ignition coil 3 and the electrode 7 of the spark plug 6 is reduced from L2 to L1 (L2>L1), this reduction (L2–L1) of the distance is absorbed as an increase of compression amount of the coiled spring 15. Furthermore, even if compression amount of the coiled spring 15 is increased, buckling of the coiled spring 15 does not happen.

Meanwhile, since the coiled spring 15 has small spring constant and small coil diameter, force at which the coiled spring 15 is brought into contact with the electrode 7 of the spark plug 6, namely, reaction force of the coiled spring 15 does not change substantially even if compression amount of the coiled spring 15 is increased.

Thus, in the ignition system K, even when the distance between the electrode 4 of the ignition coil 3 and the electrode 7 of the spark plug 6 changes, the terminal 2A can be used in common. Therefore, a molding die for molding the terminal 2B having the length L2 as shown in FIG. 2 is not required to be prepared and thus, production cost of the terminal 2A is reduced. Meanwhile, since the terminal 2B is not required to be prepared and only one kind of terminal 2A may be prepared, the number of kinds of the terminal are reduced, so that control of the components of the ignition system is simplified and thus, wrong components are not used for the ignition system, thereby resulting in improvement of reliability of the ignition system.

As is clear from the foregoing description of the ignition system for the internal combustion engine, since the buckling preventive portion is formed at the portion of the through-hole of the insulating member between the lower portion of the terminal mounted in the through-hole and the upper portion of the electrode of the spark plug fitted into the through-hole, buckling of the coiled spring is prevented. Therefore, even if the distance between the electrode of the ignition coil and the electrode of the spark plug changes, this change of the distance can be absorbed by compression amount of the coiled spring and thus, a single terminal can be used in common. Accordingly, since molding dies for molding other terminals having different lengths are not required to be prepared, production cost of the terminal can be lowered. Furthermore, since the number of kinds of the terminal is reduced, control of the components of the ignition system is simplified, so that wrong components are not used for the ignition system, thereby resulting in improvement of reliability of the ignition system.

What is claimed is:

1. An ignition system for an internal combustion engine, comprising:

a tubular insulating member which has a through-hole;

a tubular terminal which is mounted in an upper portion of the through-hole of the insulating member;

an ignition coil which has a first terminal;

the first terminal being fitted into an upper portion of the terminal so as to be electrically connected to the terminal;

a coiled spring which is attached to a lower portion of the terminal and is loosely fitted into a lower portion of the through-hole of the insulating member;

a spark plug which has a second terminal fitted into the through-hole from a lower portion of the insulating member;

the second terminal being brought into contact with the coiled spring so as to be electrically connected to the coiled spring; and a buckling preventive portion for reducing an inside diameter of the through-hole of the insulating member, which is provided at a portion of the through-hole between the lower portion of the terminal and an upper portion of the second terminal so as to prevent buckling of an intermediate portion of the coiled spring.

* * * * *

UNITED STATES PATENT AND TRADEMARK OFFICE

CERTIFICATE OF CORRECTION

PATENT NO. : 5,492,105

DATED : February 20, 1996

INVENTOR(S) : K. NAKAJIMA et al.

It is certified that error appears in the above-indentified patent and that said Letters Patent is hereby corrected as shown below:

At column 3, line 62, change "la" to ---1a---.

Signed and Sealed this

Ninth Day of July, 1996

Attest:

Bruce Lehman

BRUCE LEHMAN

Attesting Officer

Commissioner of Patents and Trademarks